US010535490B2

(12) United States Patent
Gorrilla

(10) Patent No.: US 10,535,490 B2
(45) Date of Patent: Jan. 14, 2020

(54) SYSTEM AND METHOD FOR RECIPROCATING AN ANODE IN AN X-RAY DEVICE

(71) Applicant: GENERAL ELECTRIC COMPANY, Schenectady, NY (US)

(72) Inventor: Michael William Gorrilla, Wauwatosa, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 111 days.

(21) Appl. No.: 15/814,088

(22) Filed: Nov. 15, 2017

(65) Prior Publication Data

US 2019/0148103 A1 May 16, 2019

(51) Int. Cl.
*H01J 35/28* (2006.01)
*H01J 35/12* (2006.01)

(52) U.S. Cl.
CPC ..... *H01J 35/28* (2013.01); *H01J 35/12* (2013.01)

(58) Field of Classification Search
None
See application file for complete search history.

(56) References Cited

U.S. PATENT DOCUMENTS

2006/0182223 A1* 8/2006 Heuscher ..... H01J 35/101 378/137
2010/0260324 A1* 10/2010 Legall ..... H01J 35/103 378/130

* cited by examiner

*Primary Examiner* — Hoon K Song
(74) *Attorney, Agent, or Firm* — Grogan, Tuccillo & Vanderleeden, LLP

(57) ABSTRACT

An x-ray device is presented. The x-ray device includes a cathode configured to emit an electron beam. Further, the x-ray device includes an anode having an anode surface configured to generate x-rays in response to the emitted electron beam impinging on a focal spot on the anode surface. Also, the x-ray device includes a reciprocating assembly including a drive shaft operatively coupled to the anode and a first bearing unit operatively coupled to the drive shaft, where the first bearing unit is configured to translate the anode via the drive shaft to distribute heat generated in the anode. Moreover, the x-ray device includes a first diaphragm disposed between the anode and the first bearing unit and configured to cease a flow of one or more first lubricants from the first bearing unit towards the anode.

20 Claims, 5 Drawing Sheets

SYSTEM AND METHOD FOR RECIPROCATING AN ANODE IN AN X-RAY DEVICE

BACKGROUND

Embodiments of the present specification relate generally to an x-ray device and more specifically to a system and method for reciprocating an anode in the x-ray device.

Traditional x-ray imaging system includes an x-ray source and a detector array. The x-ray source generates x-rays that pass through an object being imaged. These x-rays are attenuated while passing through the object and are received by the detector array. Further, the detector array includes detector elements that produce separate electrical signals indicative of the attenuated x-rays received by each detector element. Also, the produced electrical signals are transmitted to a data processing system for analysis, which ultimately produces an image of the object.

Typically, the x-ray source includes an anode and a cathode that are disposed in a vacuum chamber having a high voltage (HV) environment. The anode includes a focal track that is made of a relatively high atomic number material such as tungsten or molybdenum. Further, the cathode emits electrons that impinge on the focal track of the anode to generate the x-rays. While generating the x-rays, a substantial portion of the electrons that strikes the focal track of the anode may generate heat in the anode. This generated heat may increase the temperature of the anode and result in damage to the anode. Thus, it is desirable to dissipate or distribute the heat generated in the anode.

In a conventional system, the anode is rotated at high angular velocities to move the focal track that is aligned with the electrons. As the focal track rotates, areas on the focal track that are not struck by the electrons may cool down through radiant dissipation of the heat. Though some heat is dissipated through radiant energy, heat that builds up in the anode is frequently greater than the amount of heat dissipated from the anode. Therefore, the anode may be overheated and may be permanently damaged. Moreover, a bearing assembly having one or more lubricants is used to rotate the anode. During operation of the x-ray system, these lubricants may flow towards the anode and may disturb the HV environment in the x-ray system. These factors adversely impact the efficiency of generation of the x-rays in the x-ray system.

BRIEF DESCRIPTION

Briefly, in accordance with one aspect of the present specification, an x-ray device is presented. The x-ray device includes a cathode configured to emit an electron beam. Further, the x-ray device includes an anode having an anode surface configured to generate x-rays in response to the emitted electron beam impinging on a focal spot on the anode surface. Also, the x-ray device includes a vacuum envelope enclosing the cathode and the anode. Furthermore, the x-ray device includes a reciprocating assembly including a drive shaft operatively coupled to the anode and a first bearing unit operatively coupled to the drive shaft, where the first bearing unit is configured to translate the anode via the drive shaft to distribute heat generated in the anode. Also, the x-ray device includes a first diaphragm disposed between the anode and the first bearing unit and configured to cease a flow of one or more first lubricants from the first bearing unit towards the anode.

In accordance with another aspect of the present specification, a method for distributing heat in an x-ray device is presented. The method includes generating, by an anode, x-rays in response to an electron beam impinging on a focal spot on an anode surface of the anode. Further, the method includes translating, by a reciprocating assembly including a drive shaft coupled to the anode and a first bearing unit operatively coupled to the drive shaft, the anode to distribute heat generated in the anode. Also, the method includes ceasing, by a first diaphragm disposed between the anode and the first bearing unit, a flow of one or more first lubricants from the first bearing unit towards the anode.

In accordance with yet another aspect of the present specification, an x-ray system is presented. The x-ray system includes a housing including a coolant. Further, the x-ray system includes an x-ray device disposed within the housing, where the x-ray device includes a cathode configured to emit an electron beam. Also, the x-ray device includes an anode having an anode surface configured to generate x-rays in response to the emitted electron beam impinging on a focal spot on the anode surface. Furthermore, the x-ray device includes a vacuum envelope configured to enclose the cathode and the anode. In addition, the x-ray device includes a reciprocating assembly including a drive shaft coupled to the anode and a first bearing unit operatively coupled to the drive shaft, where the first bearing unit is configured to translate the anode via the drive shaft to distribute heat generated in the anode. Also, the x-ray device includes a first diaphragm disposed between the anode and the first bearing unit and configured to cease a flow of one or more first lubricants from the first bearing unit towards the anode.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As will be described in detail hereinafter, various embodiments of exemplary structures and methods for distributing heat generated in an x-ray device are presented. By employing the methods and the various embodiments of the x-ray device described hereinafter, an anode in the x-ray device is reciprocated back-and-forth to distribute the heat generated in the anode. Also, the anode is reciprocated without disturbing or affecting a high voltage (HV) environment in the x-ray device. Moreover, use of the exemplary structures and methods advantageously aid in reducing costs associated with servicing and maintaining the x-ray device.

Figure 1:
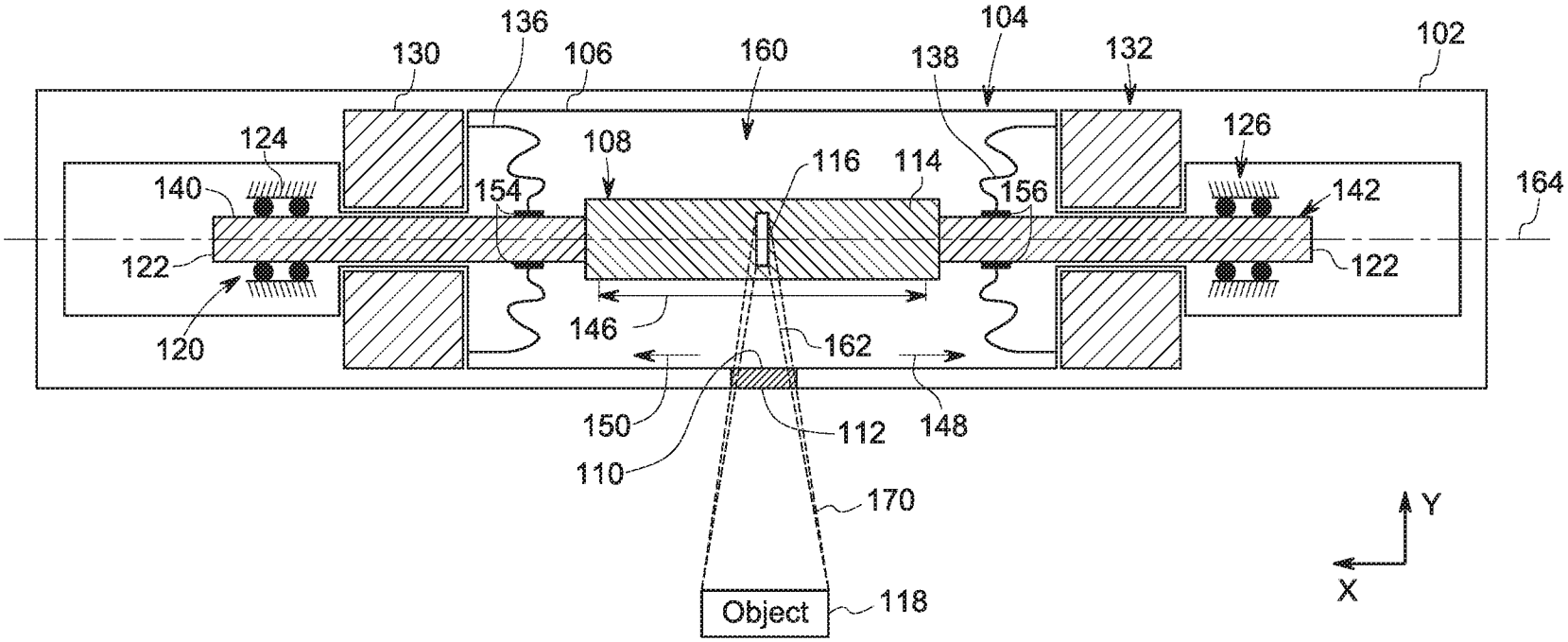
FIG. 1 is a cross sectional view of an x-ray system depicted in the XY plane, in accordance with aspects of the present specification.
Figure 2:
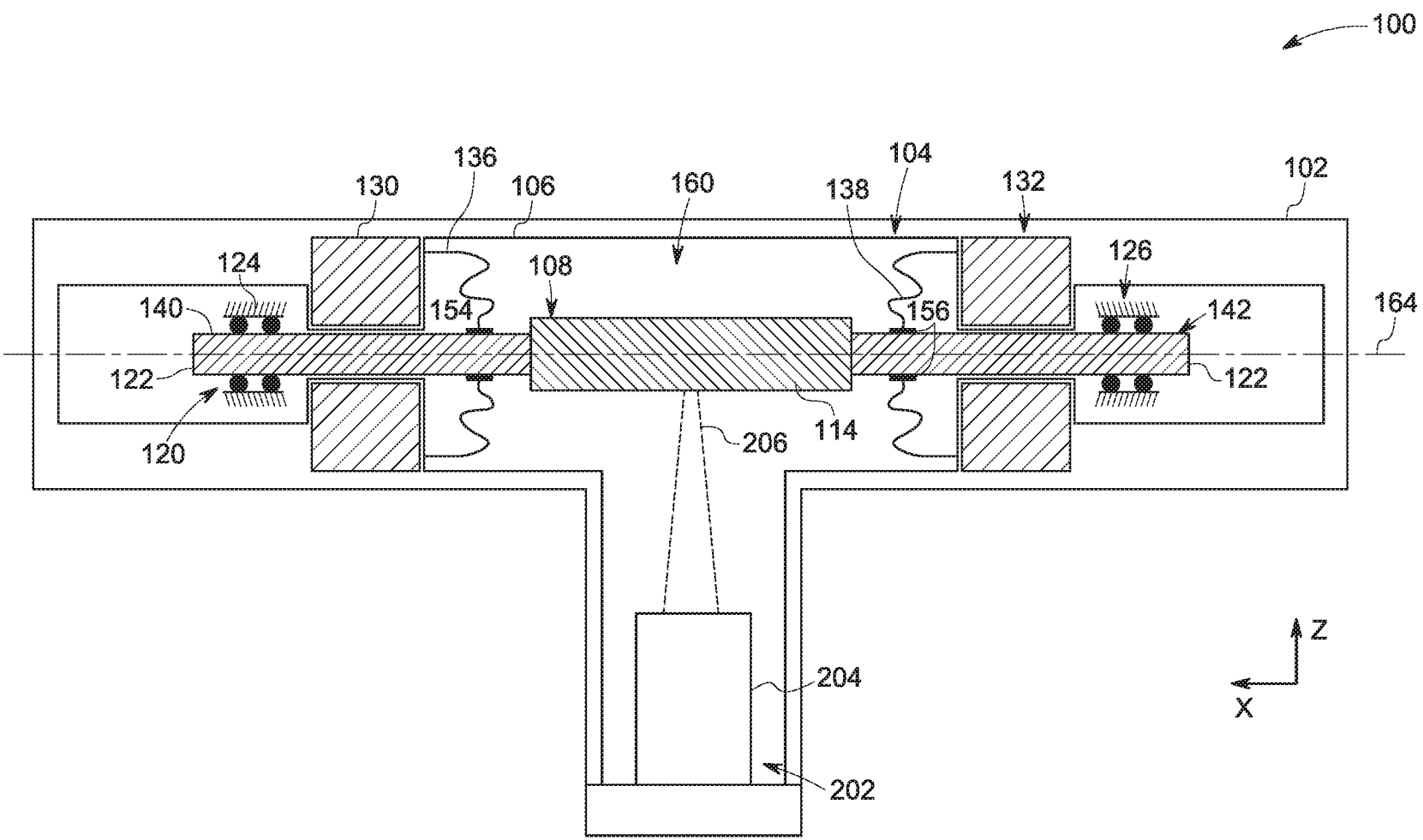
FIG. 2 is a cross sectional view of the x-ray system depicted in the XZ plane, in accordance with aspects of the present specification.

Referring to FIG. 1, a cross-sectional view of an x-ray system 100, in accordance with aspects of the present specification, is depicted. It may be noted that in FIG. 1, the x-ray system 100 is depicted in the XY plane. Further, the x-ray system 100 includes a cathode that is positioned in the Z plane, hence the cathode is not depicted in FIG. 1. However, the cathode is shown in FIG. 2. The x-ray system 100 includes a housing 102 and an x-ray device 104 that is disposed within the housing 102. Further, the housing 102 includes a coolant that is used for cooling the x-ray device 104. In one example, the coolant may include transformer oil and water. It may be noted that the x-ray system 100 may include other components, and is not limited to the components shown in FIG. 1.

In a presently contemplated configuration, the x-ray device 104 includes a vacuum envelope 106, the cathode (shown in FIG. 2), and an anode 108. Further, the cathode and the anode 108 are positioned within the vacuum envelope 106. The vacuum envelope 106 has a high voltage (HV) and stable vacuum environment. It may be noted that the terms "high voltage (HV) and stable vacuum environment" and "HV environment" may be used interchangeably. The vacuum envelope 106 may be an evacuated enclosure that is positioned within the housing 102 of the x-ray system 100. Also, the vacuum envelope 106 includes an opening 110 that is aligned with a window 112 of the housing 102. It may be noted that the terms "vacuum envelope" and "evacuated enclosure" may be used interchangeably.

In one embodiment, the cathode includes an electron source (shown in FIG. 2) for emitting electrons towards the anode 108. Particularly, an electric current is applied to the electron source, such as a filament, which causes electrons to be produced by thermionic emission. It may be noted that these emitted electrons are accelerated as an electron beam towards the anode 108.

Furthermore, the anode 108 includes an anode surface 114 that is positioned along a direction of the emitted electron beam and configured to receive the electron beam from the cathode. Particularly, the anode 108 includes a copper base having the anode surface. Moreover, the anode surface may include materials with high atomic numbers ("Z" numbers), such as rhodium, palladium, molybdenum, and/or tungsten. It may be noted that the terms "anode surface" and "target surface" may be used interchangeably.

During operation, the cathode generates the electron beam. This electron beam is accelerated towards the anode surface 114 of the anode 108 by applying a high voltage potential between the cathode and the anode 108. Further, the electron beam impinges upon the anode surface 114 at a focal spot 116 and releases kinetic energy in the form of electromagnetic radiation of very high frequency, i.e., x-rays 162.

The x-rays 162 emanate in all directions from the anode surface 114. A portion 170 of these x-rays 162 passes through the opening 110 in the vacuum envelope 106 and through the window 112 of the housing 102. This portion 170 of the x-rays 162 may be utilized to examine an object 118. Some non-limiting examples of the object 118 include a material sample, a patient, or other objects of interest. Moreover, the portion 170 of the x-rays 162 may be attenuated while passing through the object 118 and received by a detector unit (not shown). Further, the detector unit includes detector elements that produce separate electrical signals indicative of the attenuated x-rays 170 received by each detector element. Also, the electrical signals are transmitted to a data processing system (not shown). The data processing system may be configured to produce an image of the object 118 based on the electrical signals produced by the detector elements.

It may be noted that a substantial portion of the electron beam generated by the cathode strikes the focal spot 116 on the anode surface 114. The impinging electron beam may generate heat in the anode 108. This heat may in turn increases the temperature of the anode 108 and may damage the anode 108. Also, this increase in temperature may disturb the high voltage environment in the vacuum envelope 106. Consequently, the generation of the x-rays 162 by the x-ray system 100 is adversely impacted and may affect a quality of an image corresponding to the object 118.

To address these shortcomings of the currently available x-ray systems, a reciprocating assembly 120 for use in the x-ray system 100 is presented, in accordance with aspects of the present specification. The reciprocating assembly 120 is configured to reciprocate the anode 108 back-and-forth to aid in distributing the generated heat across the anode 108. More specifically, the reciprocating assembly 120 is used to translate the anode 108 along a longitudinal axis 164 of the vacuum envelope 106. As the anode 108 is translated along the axis 164, the electron beam from the cathode impinges upon different areas of the anode surface 114 along a length of the anode 108. Consequently, the heat generated is distributed across the anode 108. Further, the distributed heat may be dissipated from the anode 108.

As depicted in FIG. 1, the reciprocating assembly 120 includes a drive shaft 122, a first bearing unit 124, a second bearing unit 126, a first induction motor 130, a second induction motor 132, a first diaphragm 136, and a second diaphragm 138. The drive shaft 122 is operatively coupled to the anode 108. In one example, the drive shaft 122 may be a single unitary shaft that passes through a hollow center of the anode 108. Also, a portion of the drive shaft 122 that is positioned within the hollow center of the anode 108 is secured to the anode 108.

Further, the drive shaft 122 is an elongated structure having a first end 140 and a second end 142. The first bearing unit 124 is operatively coupled to the first end 140 of the drive shaft 122, while the second bearing unit 126 is operatively coupled to the second end 142 of the drive shaft 122. In one example, the first and second bearing units 124, 126 may be magnetic bearing units. In certain embodiments, the magnetic bearing units may be operatively coupled to the vacuum envelope 106. In another example, the first and second bearing units 124, 126 may be linear bearing units that aid in translating the drive shaft 122 along the longitudinal axis 164 of the vacuum envelope 106.

Moreover, the first bearing unit 124 may include one or more first lubricants that are used for lubricating mechanical parts/components in the first bearing unit 124. In a similar manner, the second bearing unit 126 may include one or more second lubricants that are used for lubricating mechanical parts/components in the second bearing unit 126. In one example, the first and second lubricants may include any conventional or low-cost lubricants such as mineral oil, synthetic oil, perfluorinated lubricants, dry lubricants, and the like.

In a presently contemplated configuration, the first induction motor 130 is positioned at the first end 140 of the drive shaft 122, while the second induction motor 132 is positioned at the second end 142 of the drive shaft 122. The first induction motor 130 is operatively coupled to the drive shaft 122 and the first bearing unit 124 and configured to induce a first motor force on the drive shaft 122 to translate the anode 108 along the longitudinal axis 164. Similarly, the second induction motor 132 is operatively coupled to the drive shaft 122 and the second bearing unit 126 and configured to induce a second motor force on the drive shaft 122 to translate the anode 108 along the longitudinal axis 164. In one example, the first and second induction motors 130, 132 are linear induction motors. Also, in certain embodiments, the first and second induction motors 130, 132 include rotor windings and stator windings. The rotor windings of the first and second induction motors 130, 132 are positioned within the vacuum envelope 106 and coupled to the drive shaft 122. Further, the stator windings of the first and second induction motors 130, 132 are positioned outside the vacuum envelope 106. The stator windings and the rotor windings are magnetically coupled to each other and are operated to induce motor forces on the drive shaft 122. The drive shaft 122 in turn is configured to translate the anode 108 along the longitudinal axis 164.

Moreover, the first induction motor 130 and the second induction motor 132 are symmetrically operated to induce motor forces on the drive shaft 122, which in turn is configured to translate the anode 108. It may be noted that the term "symmetrically operated" is used to refer to operating the first induction motor 130 and the second induction motor 132 in a synchronous manner. In particular, the first and second induction motors 130, 132 are operated to alternately translate the drive shaft 122 along a first direction 148 and a second direction 150. Also, it may be noted that "reciprocating motion" is used to refer to alternating the direction of motion of the drive shaft 122. More specifically, for a first time-period, the first induction motor 130 induces the first motor force on the drive shaft 122 and the second induction motor 132 induces the second motor force on the drive shaft 122 to translate the anode 108 for a determined distance 146 in the first direction 148 along the longitudinal axis 164. Further, for a second time-period, the first induction motor 130 induces the first motor force and the second induction motor 132 induces the second motor force on the drive shaft 122 to translate the anode 108 for a determined distance 146 in the second direction 150 along the longitudinal axis 164. It may be noted that the second direction 150 is opposite the first direction 148.

Thus, by employing the first and second induction motors 130, 132, the anode 108 is reciprocated back-and-forth along the longitudinal axis 164 of the vacuum envelope 106. In one example, the anode 108 is reciprocated at a translation speed that is in a range from about 10 mm/sec to about 300 mm/sec. It may be noted that in certain embodiments, the anode 108 may be translated back-and-forth via use of only one induction motor that is positioned at the first end or the second end of the drive shaft 122.

Furthermore, the first diaphragm 136 is disposed between the anode 108 and the first bearing unit 124 and configured to cease a flow of first lubricants from the first bearing unit 124 towards the anode 108. As depicted in FIG. 1, one end of the first diaphragm 136 is coupled to the vacuum envelope 106, while other end of the first diaphragm 136 is coupled to the drive shaft 122.

As will be appreciated, the drive shaft 122 may receive a portion of heat that is generated in the anode 108. In this scenario, the heat in the drive shaft 122 may be transferred to the first diaphragm 136 and may damage the first diaphragm 136. It is therefore desirable to prevent any damage to the first diaphragm 136. In accordance with aspects of the present specification, a first thermal insulator 154 may be coupled between the first diaphragm 136 and the drive shaft 122. The first thermal insulator 154 may be configured to restrict a flow of heat from the drive shaft 122 to the first diaphragm 136. More particularly, the first thermal insulator 154 may be positioned between the first diaphragm 136 and the drive shaft 122 to restrict the flow of heat from the drive shaft 122 to the first diaphragm 136.

In a similar manner, the second diaphragm 138 is disposed between the anode 108 and the second bearing unit 126 and configured to cease a flow of second lubricants from the second bearing unit 126 towards the anode 108. As depicted in FIG. 1, one end of the second diaphragm 138 is coupled to the vacuum envelope 106, while other end of the second diaphragm 138 is coupled to the drive shaft 122.

As will be appreciated, the drive shaft 122 may receive a portion of heat that is generated in the anode 108. In this scenario, the heat in the drive shaft 122 may be transferred to the second diaphragm 138 and may damage the second diaphragm 138. It is therefore desirable to prevent any damage to the second diaphragm 138. In accordance with aspects of the present specification, a second thermal insulator 156 may be coupled between the second diaphragm 138 and the drive shaft 122. The second thermal insulator 156 may be configured to restrict a flow of heat from the drive shaft 122 to the second diaphragm 138. More particularly, the second thermal insulator 156 may be positioned between the second diaphragm 138 and the drive shaft 122 to restrict the flow of heat from the drive shaft 122 to the second diaphragm 138.

In one example, the first and second thermal insulators 154, 156 may include materials, such as low thermal conductivity engineered ceramic. In another example, the first and second diaphragms 136, 138 may include materials, such as ferrous alloys and titanium alloys. Also, the first and second diaphragms 136, 138 are designed to be highly compliant and operate within fatigue limit for long life.

In the exemplary x-ray system 100, the first and second diaphragms 136, 138 may define a vacuum chamber 160 having the high voltage (HV) and stable vacuum environment. Also, the anode 108 is positioned within this vacuum chamber 160 to generate the x-rays 162. More specifically, the first diaphragm 136 is configured to partition the vacuum envelope 106 so that the first bearing unit 124 is positioned on one side of the partition, while the anode 108 is positioned on the other side of the partition. This arrangement of the first diaphragm 136 aids in ceasing or blocking the flow of the first lubricants from one side of the partition to the other side of the partition. In a similar manner, the second diaphragm 138 is configured to partition the vacuum envelope 106 so that the second bearing unit 126 is positioned on one side of the partition, while the anode 108 is positioned on the other side of the partition. This arrangement of the second diaphragm 138 aids in ceasing or blocking the flow of the second lubricants from one side of the partition to the other side of the partition.

Moreover, as the first and second diaphragms 136, 138 are configured to prevent the flow of the first and second lubricants towards the anode 108, the high voltage and stable vacuum environment may be maintained around the anode 108. In particular, a portion of the partitioned vacuum envelope 106 between the first and second diaphragms 136, 138 may act as the vacuum chamber 160 having the high voltage and stable vacuum environment. Additionally, this high voltage and stable vacuum environment around the anode 108 may be maintained or undisturbed even when the x-rays 162 are generated in the x-ray system 100.

In addition, use of the first and second diaphragms 136, 138 in the vacuum envelope 106 allows the first and second bearing units 124, 126 to be serviced without affecting the high voltage and stable vacuum environment around the anode 108. In one example, the first bearing unit 124 and/or the second bearing unit 126 may be removed from the vacuum envelope 106 for servicing. Upon servicing, the first bearing unit 124 and/or the second bearing unit 126 may be reassembled in the vacuum envelope 106. As the first and second diaphragms 136, 138 define the vacuum chamber 160, the high voltage and stable vacuum environment is maintained around the anode 108 even when the first bearing unit 124 and/or the second bearing unit 126 are serviced. Moreover, with the use of first and second diaphragms 136, 138, any type of lubricants may be used in the bearing units 124, 126. In one example, low cost conventional lubricants may be used in the bearing units 124, 126, which in turn reduces the costs associated with maintaining and/or servicing the bearing units 124, 126.

Implementing the exemplary x-ray system 100 as described hereinabove allows the anode 108 in the x-ray device 104 to be reciprocated back-and-forth to distribute the heat generated in the anode 108. Also, the anode 108 is reciprocated without disturbing or affecting the high voltage and stable vacuum environment in the x-ray device 104. Moreover, the bearing units 124, 126 may be serviced or replaced without affecting the high voltage and stable vacuum environment in the x-ray device 104, thereby reducing the costs associated with servicing and/or maintaining the x-ray system 100.

Referring to FIG. 2, a diagrammatical representation of another cross-sectional view of the x-ray system 100 of FIG. 1, in accordance with aspects of the present specification, is depicted. It may be noted that in FIG. 2, the x-ray system 100 is depicted in the XZ plane. Further, as the object is positioned on the Y plane, the object is not shown in FIG. 2.

As previously noted with reference to FIG. 1, the x-ray system 100 includes the vacuum envelope 106, the anode 108, and a cathode 202. Moreover, in the embodiment of FIG. 2, the cathode 202 is configured to emit an electron beam 206 towards the anode 108. In particular, the cathode 202 is positioned within the vacuum envelope 106 of the x-ray system 100. Further, the cathode 202 includes an electron source 204 for emitting electron beam 206 towards the anode 108. More specifically, an electric current is applied to the electron source 204, such as a filament, which causes electrons to be produced by thermionic emission. The electric current may be applied by a high voltage connector (not shown) that is electrically coupled between a voltage source (not shown) and the cathode 202. Further, these emitted electrons are accelerated as the electron beam 206 travels towards the anode 108. Also, the accelerated electron beam 206 impinges upon the anode surface 114 and releases kinetic energy in the form of electromagnetic radiation of very high frequency, i.e., x-rays 162.

Figure 3:
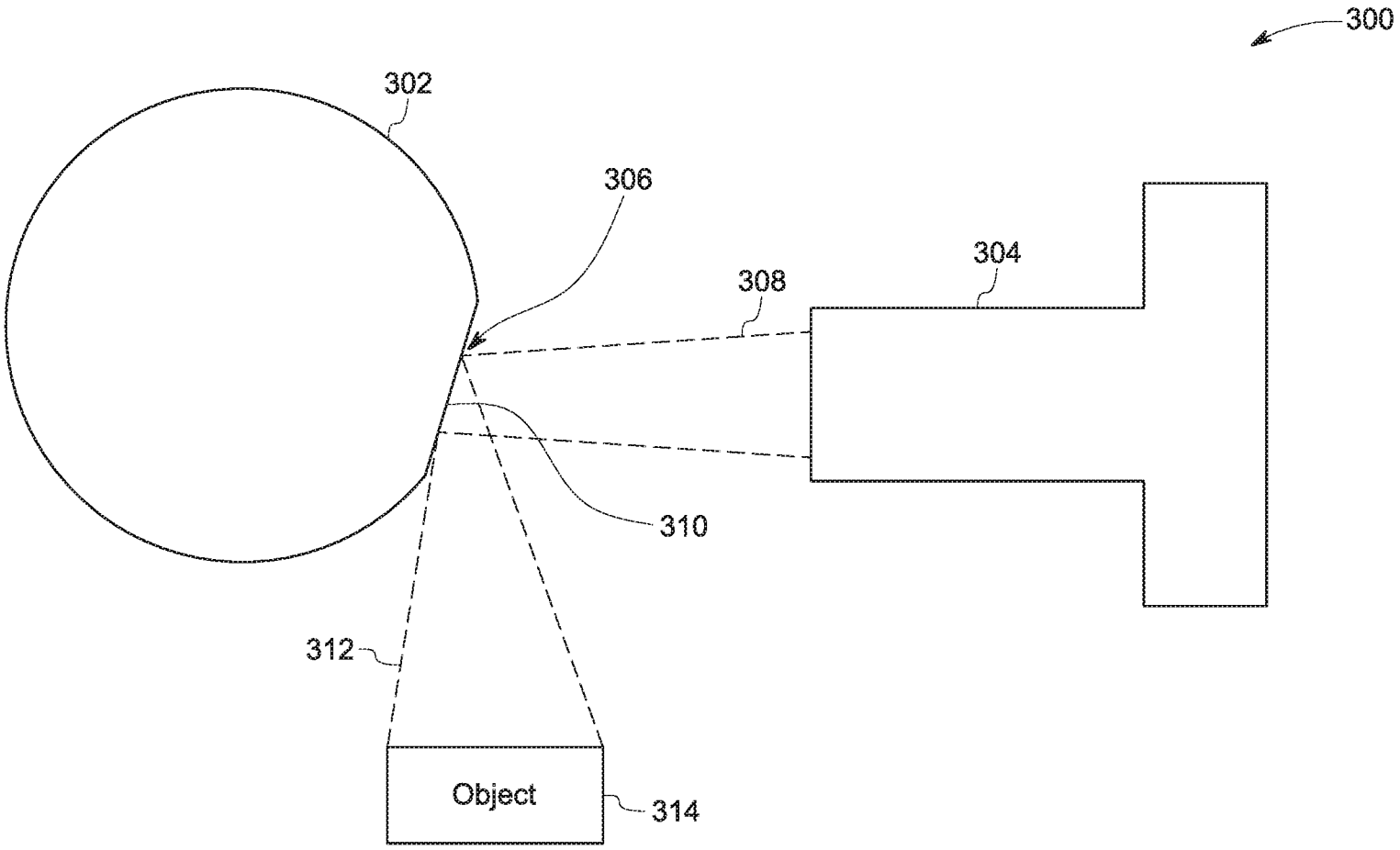
FIG. 3 is a side view of a portion of the x-ray system depicting one embodiment of an anode and the cathode, in accordance with aspects of the present specification.

FIG. 3 is a side view 300 of a portion of an x-ray system such as the x-ray system 100 of FIG. 1, in accordance with aspects of the present specification. In the embodiment of FIG. 3, the x-ray system 300 includes an anode 302 and a cathode 304. The x-ray system 300 is similar to the x-ray system 100 of FIG. 1. However, in the embodiment of FIG. 3, an anode surface 306 is truncated at a determined angle to optimize a focal spot on the anode surface 306. In one example, the determined angle may be in a range from about 7 degrees to about 15 degrees. More specifically, a portion of the anode surface 306 that is facing the cathode 304 is beveled. Furthermore, an electron beam 308 generated by the cathode 304 is configured to impinge upon a beveled surface 310 of the anode 302. Also, the beveled surface 310 is angled to create an optimized focal spot on the anode surface 306 of the anode 302. Moreover, the beveled surface 310 is angled towards an opening in a vacuum envelope to optimize the generation of x-rays 312 in the x-ray system 300. In one embodiment, the focal spot is optimized to increase the intensity of the x-rays 312, which in turn improves a quality of an image of an object 314.

Figure 4:
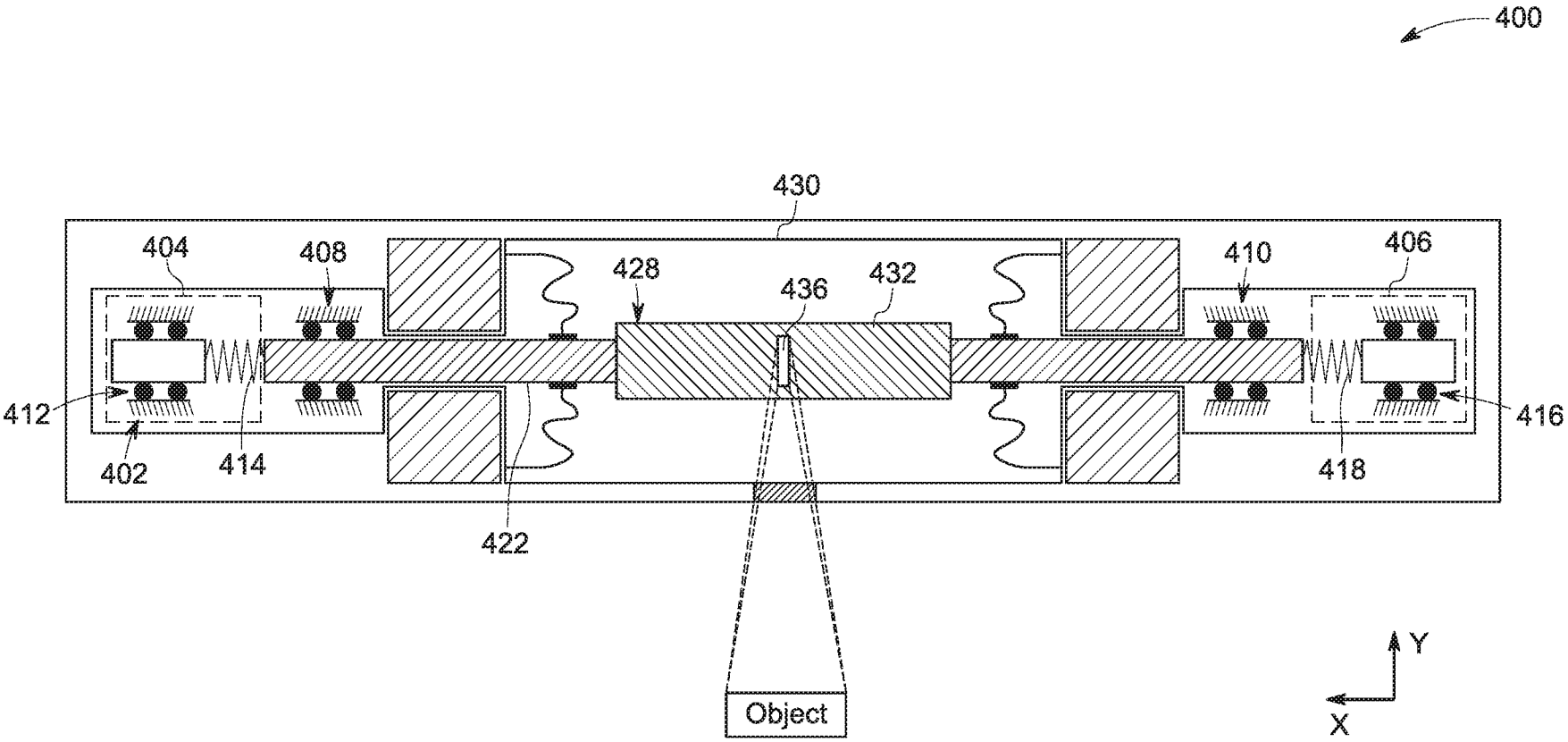
FIG. 4 is a cross sectional view of another embodiment of the x-ray system depicted in the XY plane, in accordance with one embodiment of the present specification.

Turning to FIG. 4, a diagrammatical representation of a cross sectional view 400 of another embodiment of an x-ray system depicted in the XY plane, in accordance with aspects of the present specification, is depicted. The x-ray system 400 includes an anode 428, a cathode (not shown in FIG. 4), a drive shaft 422, a first bearing unit 408, a second bearing unit 410, and a vacuum envelope 430. The cathode and the anode 428 are positioned within the vacuum envelope 430. Further, the cathode includes an electron source (not shown in FIG. 4) for emitting an electron beam towards the anode 428. The anode 428 includes an anode surface 432 that is positioned along a direction of the emitted electron beam and configured to receive the electron beam from the cathode. Further, the electron beam is accelerated from the cathode towards the anode 428 to impinge upon the anode surface 432 at a focal spot 436 to generate x-rays.

The x-ray system 400 is similar to the x-ray system 100 of FIG. 1. However, in the embodiment of FIG. 4, the x-ray system 400 includes a reciprocating assembly 402. The reciprocating assembly 402 includes a first balancing unit 404 and a second balancing unit 406. The first and second balancing units 404, 406 are configured to reduce or minimize any imbalance in the drive shaft 422 and/or eliminate vibrations in the drive shaft 422. The first balancing unit 404 is operatively coupled to the first bearing unit 408, while the second balancing unit 406 is coupled to the second bearing unit 410, as depicted in FIG. 4. Further, the first balancing unit 404 includes a first counter mass 412 and a first spring 414 that is operatively coupled between the first counter mass 412 and the drive shaft 422. Similarly, the second balancing unit 406 includes a second counter mass 416 and a second spring 418 that is operatively coupled between the second counter mass 416 and the drive shaft 422.

During operation of the x-ray system 400, the first and second balancing units 404, 406 may each impose a counter force on the drive shaft 422 to effectively reduce or minimize any imbalance in the drive shaft 422 and/or eliminate vibrations in the drive shaft 422. In particular, when the anode 428 and the drive shaft 422 are translated back-and-forth in the vacuum envelope 430, a reciprocating/translating motion of the drive shaft 422 may induce a force on the first and second counter masses 412, 416 via the first and second springs 414, 418. In response, the first and second counter masses 412, 416 may impose the counter force on the drive shaft 422 via the first and second springs 414, 418. As a result, the vibrations in the drive shaft 422 and/or any imbalance in the drive shaft 422 may be substantially reduced. In one example, the first and second counter masses 412, 416 include materials such as stainless steel.

Also, the first and second counter masses 412, 416 are used to balance the anode 428 via the first and second springs 414, 418. In particular, the anode 428 is dynamically balanced by the combined inertial loads of the first and second springs 414, 418, and the corresponding counter masses 412, 416. Moreover, the anode 428 is dynamically balanced by the spring rates of the springs 414, and 418. More specifically, as the anode 428 is reciprocated along a longitudinal axis of the vacuum envelope 430, the counter masses 412, 416 are also reciprocated but in the opposite direction such that a single location in each of the springs 414, 418 remains stationary.

Figure 5:
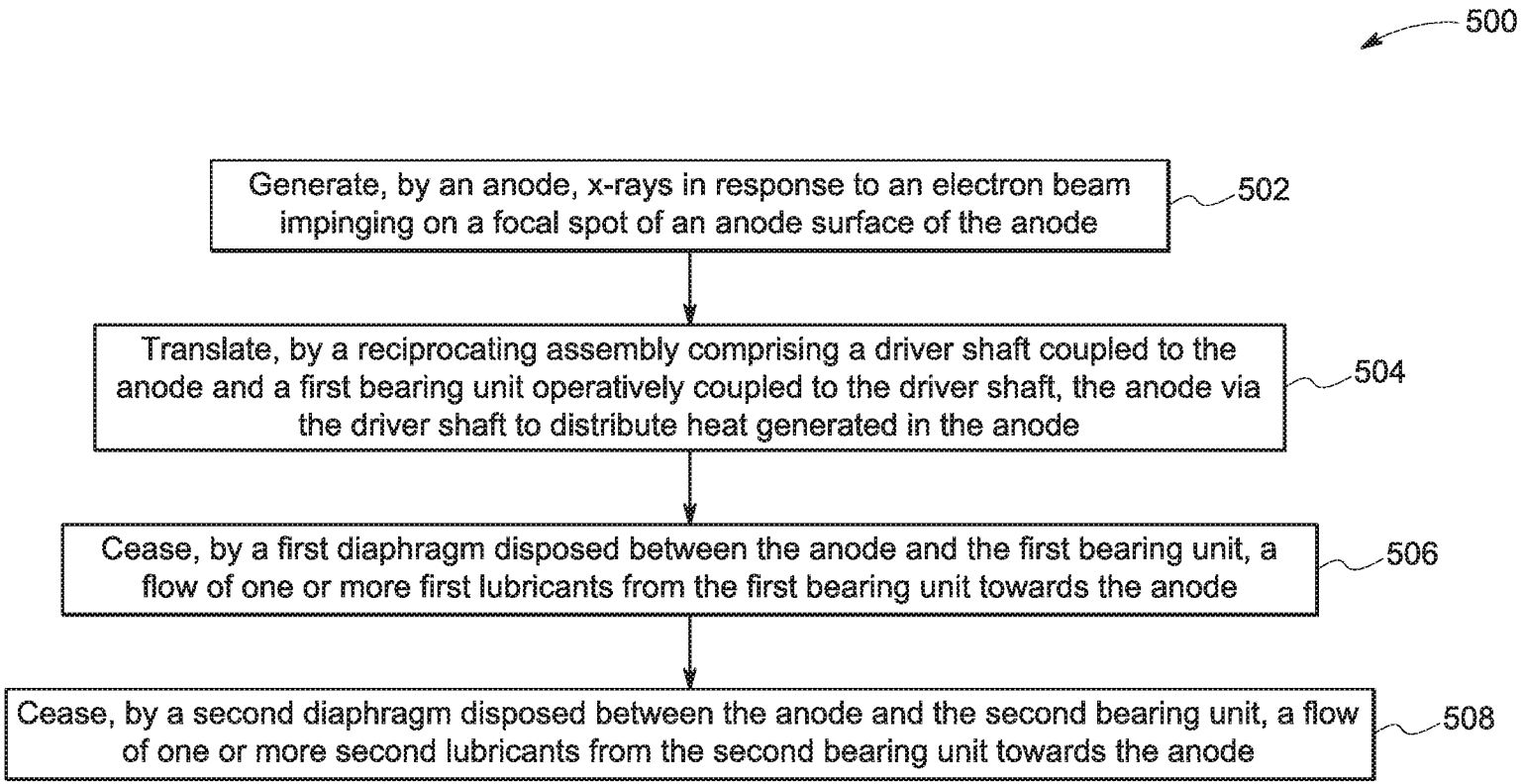
FIG. 5 is a flow chart illustrating a method for distributing heat in the anode and ceasing a flow of lubricants towards the anode in the x-ray system, in accordance with aspects of the present specification.

Referring to FIG. 5, a flow chart illustrating a method 500 for distributing heat generated in the anode of the x-ray device/system, in accordance with aspects of the present specification, is depicted. In addition, the method 500 may also entail ceasing the flow of lubricants from the reciprocating assembly towards the anode in the x-ray system. For ease of understanding, the method 500 is described with reference to the components of FIGS. 1 and 2.

The method begins at step 502, where the anode 108 generates the x-rays 162 in response to the electron beam 206 impinging on the focal spot 116 on the anode surface 114 of the anode 108. In particular, the cathode 202 generates electrons that are accelerated towards the anode surface 114 of the anode 108 by applying the high voltage potential between the cathode 202 and the anode 108. These electrons in the form of the electron beam 206 impinge upon the anode surface 114 at the focal spot 116 and release kinetic energy in the form of electromagnetic radiation of very high frequency, i.e., the x-rays 162. These x-rays 162 emanate in all directions from the anode surface 114. A portion 170 of these x-rays 162 passes through the opening 110 in the vacuum envelope 106 and through the window 112 in the housing 102 to exit the x-ray system 100.

As previously noted, the electron beam 206 impinging on the anode surface 114 results in the generation of heat on the anode surface 114 at the focal spot 116. The heat so generated may damage the anode 108. In accordance with aspects of the present specification, the heat may be distributed across the anode surface 114, thereby minimizing any damage to the anode 108. Accordingly, at step 504, the anode 108 is translated to distribute the heat generated in the anode 108. To that end, the x-ray system 100 includes the reciprocating assembly 120. The reciprocating assembly 120 is used to translate the anode 108 along the longitudinal axis 164 of the vacuum envelope 106.

In particular, the reciprocating assembly 120 includes the first bearing unit 124 operatively coupled to the first end 140 of the drive shaft 122 and the second bearing unit 126 operatively coupled to the second end 142 of the drive shaft 122. Further, the first induction motor 130 is operatively coupled to the drive shaft 122 and the first bearing unit 124 and configured to induce the first motor force on the drive shaft 122. The first motor force is employed to translate the anode 108 along the longitudinal axis 164. Similarly, the second induction motor 132 is operatively coupled to the drive shaft 122 and the second bearing unit 126 and configured to induce the second motor force on the drive shaft 122. Further, the second motor force is employed to translate the anode 108 along the longitudinal axis 164.

Moreover, the second induction motor 132 is symmetrically operated with the first induction motor 130 to provide a reciprocating motion to the anode 108. In particular, the first induction motor 130 and the second induction motor 132 are symmetrically operated to translate the drive shaft 122 and the anode 108 back-and-forth along the longitudinal axis 164 of the x-ray system 100. Consequent to the back-and-forth motion, the anode 108 is subject to the reciprocating motion. Also, this reciprocating motion of the anode 108 results in the electron beam 206 from the cathode 202 impinging upon different areas of the anode surface 114 along a length of the anode 108. As a result, the heat generated in the anode 108 is distributed across the anode 108. Moreover, the coolant in the housing 102 may be used to dissipate the distributed heat from the anode 108 and the x-ray device 106.

In addition to facilitating the distribution of heat in the anode 108, the exemplary x-ray system 100 may also be configured to prevent any flow of lubricants from the bearing units 124, 126 towards the anode 108, thereby maintaining the high voltage environment in the anode 108. Accordingly, at step 506, a flow of one or more first lubricants from the first bearing unit 124 towards the anode 108 is ceased. To that end, the first diaphragm 136 is disposed between the anode 108 and the first bearing unit 124. In particular, one end of the first diaphragm 136 is coupled to the vacuum envelope 106, while other end of the first diaphragm 136 is coupled to the drive shaft 122. This arrangement of the first diaphragm 136 aids in preventing the flow of the first lubricants from the first bearing unit 124 towards the anode 108.

Additionally, in certain embodiments, the first thermal insulator 154 may be coupled between the first diaphragm 136 and the drive shaft 122. The first thermal insulator 154 is configured to restrict a flow of heat from the drive shaft 122 to the first diaphragm 136.

Moreover, at step 508, a flow of one or more second lubricants from the second bearing unit 126 towards the anode 108 is ceased. To that end the second diaphragm 138 is disposed between the anode 108 and the second bearing unit 126. In particular, one end of the second diaphragm 138 is coupled to the vacuum envelope 106, while other end of the second diaphragm 138 is coupled to the drive shaft 122. This arrangement of the second diaphragm 138 aids in preventing the flow of the second lubricants from the second bearing unit 126 towards the anode 108.

Further, in certain embodiments, the second thermal insulator 156 may be coupled between the second diaphragm 138 and the drive shaft 122. The second thermal insulator 156 is configured to restrict the flow of heat from the drive shaft 122 to the second diaphragm 138. Moreover, the first and second diaphragms 136, 138 may define the vacuum chamber 160 having the high voltage and stable vacuum environment.

The various embodiments of the x-ray systems, the x-ray devices, and the method described hereinabove, aid in distributing the heat generated in the anode, thereby minimizing any damage to the anode and enhancing the efficiency of generating the x-rays. The exemplary reciprocating assembly aids in translating the anode back-and-forth along the longitudinal axis of the x-ray device to facilitate the distribution of heat in the anode. Also, the anode is reciprocated without disturbing or affecting the high voltage and stable vacuum environment in the x-ray device. Moreover, the bearing units may be serviced, repaired, and/or replaced without affecting the high voltage and stable vacuum environment in the x-ray device, thereby reducing costs associated with servicing and maintenance of the x-ray system. In addition, the focal spot on the anode surface is optimized to improve the quality of the image of the object being scanned/imaged.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An x-ray device, comprising:

a cathode configured to emit an electron beam;

an anode having an anode surface configured to generate x-rays in response to the emitted electron beam impinging on a focal spot on the anode surface;

a vacuum envelope configured to enclose the cathode and the anode;

a reciprocating assembly comprising:

a drive shaft operatively coupled to the anode;

a first bearing unit operatively coupled to the drive shaft, wherein the first bearing unit is configured to translate the anode via the drive shaft to distribute heat generated in the anode; and a first diaphragm disposed between the anode and the first bearing unit and configured to cease a flow of one or more first lubricants from the first bearing unit towards the anode.

2. The x-ray device of claim 1, wherein the first bearing unit is operatively coupled to a first end of the drive shaft and configured to translate the anode along a longitudinal axis of the vacuum envelope.

3. The x-ray device of claim 2, further comprising a second bearing unit operatively coupled to a second end of the drive shaft and configured to translate the anode along the longitudinal axis of the vacuum envelope.

4. The x-ray device of claim 3, further comprising a second diaphragm disposed between the anode and the second bearing unit and configured to cease a flow of one or more second lubricants from the second bearing unit towards the anode.

5. The x-ray device of claim 4, further comprising a first thermal insulator coupled between the first diaphragm and the drive shaft and configured to restrict a flow of heat from the drive shaft to the first diaphragm.

6. The x-ray device of claim 4, further comprising a second thermal insulator coupled between the second diaphragm and the drive shaft and configured to restrict a flow of heat from the drive shaft to the second diaphragm.

7. The x-ray device of claim 4, wherein the first diaphragm and the second diaphragm define a vacuum chamber having a high voltage and stable vacuum environment, and wherein the anode is positioned within the vacuum chamber to generate the x-rays.

8. The x-ray device of claim 3, wherein the reciprocating assembly further comprises a first induction motor operatively coupled to the drive shaft and the first bearing unit and configured to induce a first motor force on the drive shaft to translate the anode.

9. The x-ray device of claim 3, wherein the reciprocating assembly further comprises a second induction motor operatively coupled to the drive shaft and the second bearing unit and configured to induce a second motor force on the drive shaft to translate the anode, and wherein the second induction motor is symmetrically operated with the first induction motor to provide a reciprocating motion to the anode.

10. The x-ray device of claim 1, wherein at least a portion of the anode surface of the anode is truncated at a determined angle to optimize the focal spot on the anode surface.

11. A method, comprising:

generating, by an anode, x-rays in response to an electron beam impinging on a focal spot on an anode surface of the anode;

translating, by a reciprocating assembly comprising a drive shaft coupled to the anode and a first bearing unit operatively coupled to the drive shaft, the anode to distribute heat generated in the anode; and ceasing, by a first diaphragm disposed between the anode and the first bearing unit, a flow of one or more first lubricants from the first bearing unit towards the anode.

12. The method of claim 11, further comprising ceasing, by a second diaphragm disposed between the anode and the second bearing unit, a flow of one or more second lubricants from the second bearing unit towards the anode.

13. The method of claim 12, further comprising restricting, by a first thermal insulator operatively coupled between the first diaphragm and the drive shaft, a flow of heat from the drive shaft to the first diaphragm.

14. The method of claim 12, further comprising restricting, by a second thermal insulator operatively coupled between the second diaphragm and the drive shaft, a flow of heat from the drive shaft to the second diaphragm.

15. The method of claim 11, further comprising inducing, by a first induction motor operatively coupled to the drive shaft and the first bearing unit, a first motor force on the drive shaft to translate the anode.

16. The method of claim 15, further comprising inducing, by a second induction motor operatively coupled to the drive shaft and the second bearing unit, a second motor force on the drive shaft to translate the anode.

17. The method of claim 16, further comprising symmetrically operating the second induction motor with the first induction motor to provide a reciprocating motion to the anode.

18. An x-ray system, comprising:

a housing;

an x-ray device disposed within the housing, wherein the x-ray device comprises:

a cathode configured to emit an electron beam;

an anode having an anode surface configured to generate x-rays in response to the emitted electron beam impinging on a focal spot on the anode surface;

a vacuum envelope configured to enclose the cathode and the anode;

a reciprocating assembly comprising:

a drive shaft coupled to the anode;

a first bearing unit operatively coupled to the drive shaft, wherein the first bearing unit is configured to translate the anode via the drive shaft to distribute heat generated in the anode; and a first diaphragm disposed between the anode and the first bearing unit and configured to cease a flow of one or more first lubricants from the first bearing unit towards the anode.

19. The x-ray system of claim 18, wherein the vacuum envelope comprises an opening aligned with a window in the housing to convey the generated x-rays towards an object of interest.

20. The x-ray system of claim 18, wherein at least a portion of the anode surface of the anode is truncated at a determined angle along a longitudinal axis of the vacuum envelope to optimize the focal spot on the anode surface.

* * * * *